US005747758A

United States Patent [19]

Hochgesang et al.

[11] Patent Number: 5,747,758

[45] Date of Patent: May 5, 1998

[54] KEYBOARD ARRANGEMENT

[75] Inventors: Gerhard Hochgesang, Neustadt a. d. Seale; Andrea Grosse, Dietzhausen, both of Germany

[73] Assignee: Preh-Werke GmbH & Co. KG, Bad Neustadt, Germany

[21] Appl. No.: 720,015

[22] Filed: Sep. 27, 1996

[30] Foreign Application Priority Data

Sep. 28, 1995 [DE] Germany ..... 195 36 071.0

[51] Int. Cl.[6] ..... H01H 9/20

[52] U.S. Cl. ..... 200/5 A; 200/344

[58] Field of Search ..... 200/5 A, 17 R, 200/344, 341, 345, 517, 336, 16 R

[56] References Cited

U.S. PATENT DOCUMENTS

| | | | |
|---|---|---|---|
| 4,392,037 | 7/1983 | Fleming | 200/340 |
| 5,278,371 | 1/1994 | Watanabe et al. | 200/344 |
| 5,278,372 | 1/1994 | Takagi et al. | 200/344 |
| 5,329,084 | 7/1994 | Watanabe et al. | 200/344 |
| 5,463,195 | 10/1995 | Watanabe et al. | 200/5 A |
| 5,504,283 | 4/1996 | Kako et al. | 200/5 A |

FOREIGN PATENT DOCUMENTS

| | | |
|---|---|---|
| 33 29 698 | 1/1988 | Germany . |
| 37 19 839 | 10/1988 | Germany . |

*Primary Examiner*—Edward Tso

*Attorney, Agent, or Firm*—Griffin, Butler Whisenhunt & Szipl

[57] ABSTRACT

A scissor mount for a large, multi-contact key of a keyboard, prevents key tilt upon off-center actuation of the key. Such keys are often lifted from immovable portions of keyboards and then remounted in order to change contacts that are activated by the keys. When this is improperly carried out, guide slits can become deformed and the entire apparatus becomes unusable. In the arrangement of this invention, scissor arms (7), whose guide pins (8) ride in guide slots (10) of fixed keyboard parts, are formed as springs, with ends of the guide pins being inclined for engaging and sliding over guide-slot walls during installation so that the scissor arms can spring inwardly until the guide pins snap into the guide slots. With this arrangement deformation of guide-slot walls is avoided and an easier mounting is made possible.

3 Claims, 2 Drawing Sheets

KEYBOARD ARRANGEMENT

BACKGROUND OF THE INVENTION

This invention relates to a keyboard arrangement in which a large key covers more than one contact; more particularly, the invention relates to such a keyboard arrangement in which a tilt of the large key caused by off-center actuation thereof is avoided by use of a scissor arrangement between the movable large key and a fixed base plate with scissor arms of the scissor arrangement having guide pins riding in guide slots on both the large key and on the base plate.

From German Patent DE-A1-3329698 it is known to have individual keys of keyboards which are significantly larger than other keys and large in comparison with a contact to be actuated therewith. To avoid a tilt upon an off-center actuation of the larger key a guide arrangement is provided between movable and immovable parts comprised of two scissor-like mounts. The axes of the two scissor mounts are aligned with one another and four support points of upper free ends of the scissor arms define a rectangular area which is substantially covered by an actuation surface of the key.

To improve operation, it is suggested in DE-C1 3719839 that such a guide arrangement be held in a rest position by a notch arrangement with lugs of the guide arrangement lying adjacent guide slots. Depression of the key causes the guide arrangement to move to an operation position. The lugs thereby move in the guide slots.

If often happens in practice that the large keys are lifted from immovable parts on the base plate and then mounted again so that another contact is engaged. When this is improperly done, entrance ways of the guidance slots can be deformed and the entire arrangement can be thereby rendered unusable.

Thus, it is an object of this invention to provide such a keyboard arrangement in which such deformations of the guidance slots are avoided and which also allows a simplified construction.

SUMMARY OF THE INVENTION

In accordance with the invention, scissor arms of the scissor arrangement having guide pins supported in guide slots of the fixed base plate are formed as springs, and guide pin ends have inclined surfaces which engage walls defining the guide slots so that the guide pins (8) can be detented or snapped into the guide slots.

BRIEF DESCRIPTION OF THE DRAWINGS

The foregoing and other features and objects of the invention will now be described with an exemplary embodiment in accordance with the drawings attached hereto.

DETAILED DESCRIPTION

Figure 1:
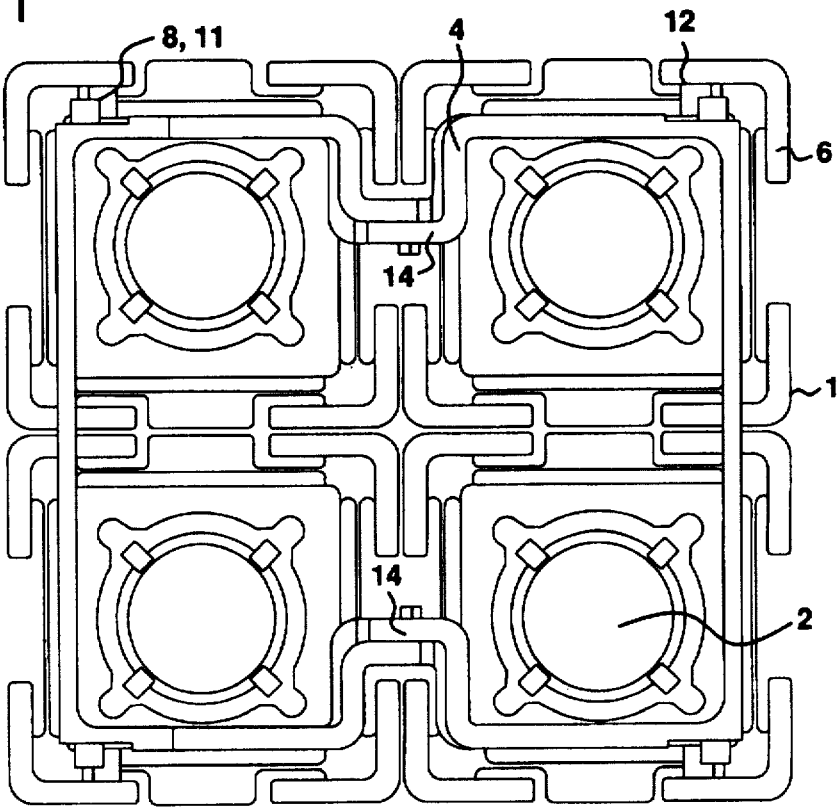
FIG. 1 is a plan view of a keyboard field to be covered by a large key and a scissor arrangement for guiding such a large key.

Reference to FIG. 1 shows a plan view of a keyboard field 1 with four contacts 2, all of which are to be for example, have only one actuating cam for actuating one of the contacts (not shown). Rotation of key 3 can select any one of the contacts 2 which are designed for a certain function. To avoid a tilt of key 3 upon an offcenter application of force, there is provided a scissor arrangement 4 which is arranged between the movable key 3 and immovable, fixed, keyboard parts 6 fixed on a base plate 5. The scissor arrangement 4 includes scissor arms 7 on which are arranged guide pins 8 which are supported in guide slots 9 of the key 3 and in guide slots 10 of the immovable keyboard parts 6. The scissor arrangement 4 assures that when the key 3 is actuated off-center, other areas are displaced in parallel so that the key 3 does not tilt. A switching of the contact is not influenced by the scissor arrangement 4.

In accordance with the invention, the scissor arms 7, the guide pins 8 which are supported in the guide slots 10 of the fixed keyboard part 6 are formed as springs. Inclined surfaces 11 at ends of the guide pins engage walls 12 defining the guide slots during mounting to spring inwardly until the guide pins 8 snap into the guide slots 10.

These measures allow elimination of known detent mechanisms for the mounting of the keys known from the prior art.

Figure 2:
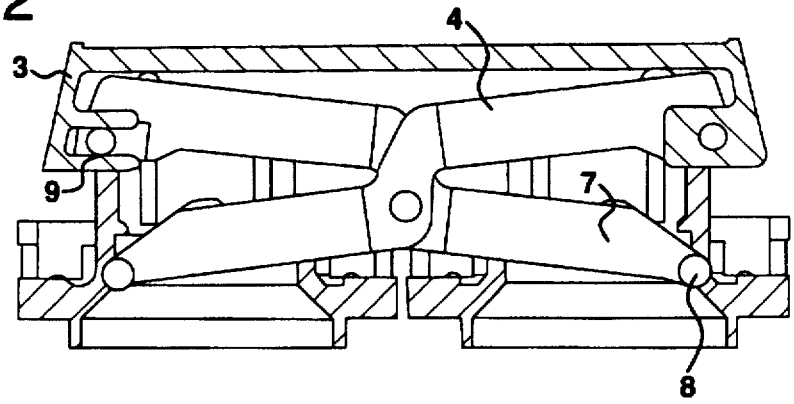
FIG. 2 is a side partially-cutaway view of the structure of FIG. 1, but further including the large key and not including a base plate, with the scissor arrangement being in an underpressed position.
Figure 3:
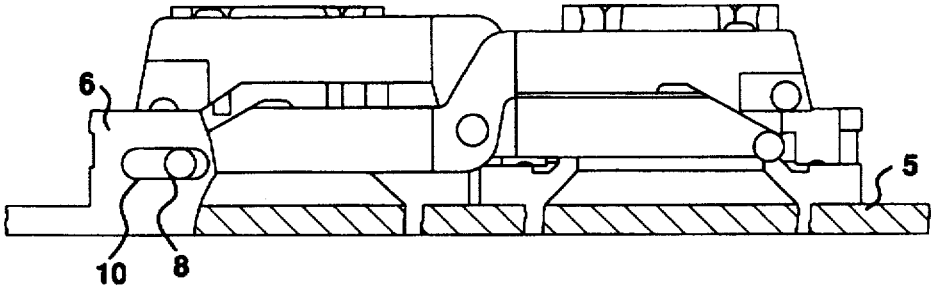
FIG. 3 is a side partially-cutaway view of the structure of FIG. 1 with the scissor arrangement being in a depressed position.
Figure 4:
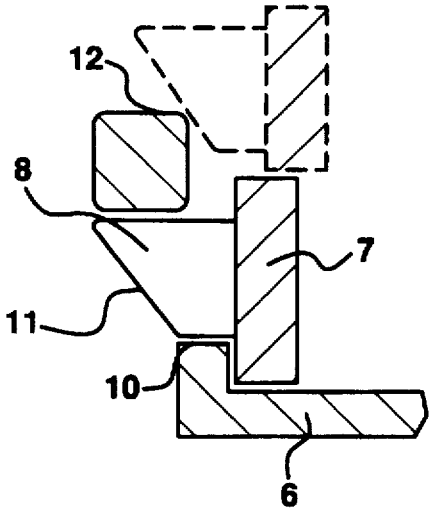
FIG. 4 and 5 are cross-sectional views showing details of the structures of 1 through 3.
Figure 5:
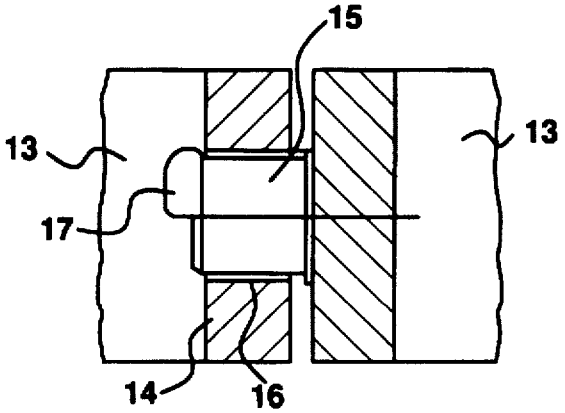

The guide slots 10 in the immovable keyboard part 6 can be closed guide slots 10 as shown in the left part of FIG. 3 since the guide pins 8 can be detented, or snapped, into the guide slots from 10 from any direction by slipping past the guide slot wall 12, as shown in FIG. 4. In a preferred embodiment, the scissor mount arrangement 4 is comprised of two identical frame parts 13, with each scissor arm pair being connected at an axial mount 14. The axial mounts 14 are each comprised of an axial pin 15 of one frame part 13 and an axial mount bushing hole 16 of the other frame part, and they are secured together in an axial direction by a projection 17 of the pin 15. This arrangement allows an easy mounting of the scissor mount arrangement 4.

Figure 6:
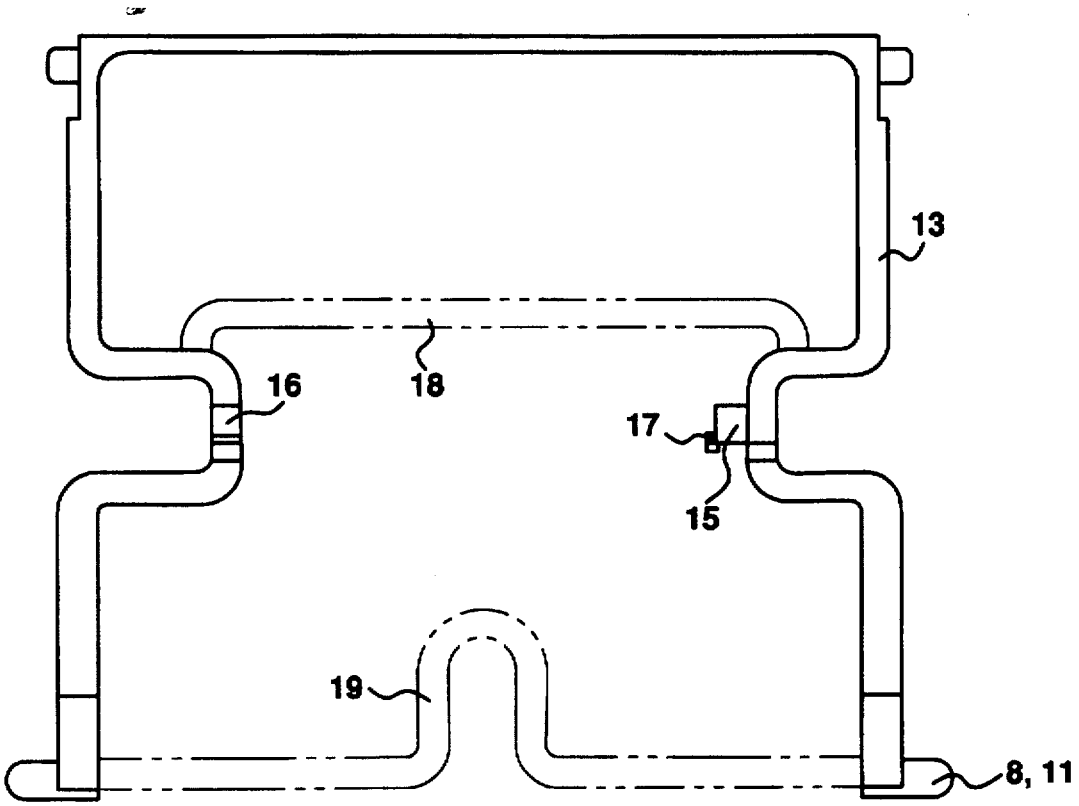
FIG. 6 is a top view of a frame part as a single part by itself.

As exemplified in FIG. 6, in which a frame part is shown as a single part, the spring property of the scissor arms 4 can be achieved by making the frame parts 13 to have a U-shape with, in certain cases, a frame wall 18 in a center region as shown in dotted lines, or a U-like frame loop 19, also shown in dotted lines. Frame wall 18 or frame loop 19 increases a recovery stiffness of the frame part 13 without substantially reducing the spring function of the scissor arms 7.

What is claimed is:

1. A keyboard apparatus for a large, multicontact, moveable key of a keyboard, said the keyboard apparatus including:

a scissor apparatus arranged between the moveable key and immovable parts of the keyboard for preventing key tilt upon off-center application of force to the moveable key, said scissor apparatus comprising scissor arms with guide pins protruding outwardly therefrom;

immovable guide-slot walls attached to said immovable parts of the keyboard for defining guide slots for receiving and guiding said guide pins of said scissor arms;

wherein the scissor arms are formed as springs for allowing spring axial movement of said guide pins, with outer ends of said guide pins having inclined surfaces relative to planes perpendicular to axes of said pins, for engaging the guide-slot walls during mounting of the scissor arms to thereby cause said scissor arms to spring inwardly until said guide pins clear said guide walls and snap into said guide slots under spring action of said scissor arms.

2. A keyboard apparatus as in claim 1 wherein the scissor apparatus is formed of first and second identical frame parts which are mounted together, with each of said first and second frame parts being formed of two scissor-arms coupled together to form a spring, with each scissor arm of said first frame part having an axial mount portion coupled to an axial mount portion of a scissor arm of the second frame part, with one of the axial mount portions being formed as an axial pin and the other axial mount portion being formed as an axial support bushing having a hole for receiving the pin, said axial pin having a projection thereon for retaining it in the bushing.

3. A keyboard apparatus as in claim 2 wherein each of said first and second frame part has a U-shape and wherein a spring characteristic of the scissor arms is created by the U-shape of the frame part with the scissor arms being arms of the U and being caused to spring outwardly if pressed toward one another.

* * * * *